US006217081B1

(12) United States Patent
Filk

(10) Patent No.: US 6,217,081 B1
(45) Date of Patent: Apr. 17, 2001

(54) DEVICE FOR COUPLING AND UNCOUPLING THE MEDIA SUPPLY LINES AT BEARING CHOCKS OF ROLLS, PARTICULARLY BACK-UP ROLLS, MOUNTED IN ROLL HOUSINGS

(75) Inventor: Edgar Filk, Netphen (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/281,447

(22) Filed: Mar. 30, 1999

(30) Foreign Application Priority Data

Apr. 3, 1998 (DE) ..... 298 06 132 U

(51) Int. Cl.[7] ..... F16L 37/08
(52) U.S. Cl. ..... 285/18; 285/124.3; 285/26
(58) Field of Search ..... 285/18, 24, 26, 285/27, 124.1–124.5

(56) References Cited

U.S. PATENT DOCUMENTS 3,580,615 * 5/1971 Prosser ..... 285/124.3
3,776,575 * 12/1973 Gilvar et al. ..... 285/18
4,615,546 * 10/1986 Nash et al. ..... 285/124.3
4,915,419 * 4/1990 Smith, III ..... 285/124.3
5,333,691 * 8/1994 Dean et al. ..... 285/26
5,924,741 * 7/1999 Karlsen ..... 285/124.3

* cited by examiner

*Primary Examiner*—Eric K. Nicholson
(74) *Attorney, Agent, or Firm*—Friedrich Kueffner

(57) ABSTRACT

A device for coupling and uncoupling the media supply lines at bearing chocks of rolls, particularly back-up rolls, mounted in roll housings, wherein the coupling elements of the media supply lines are arranged commonly in a carrier member so as to face the media connections in the bearing chock, wherein the carrier member is guided in a guide frame so as to be movable parallel to the direction of the adjustment movement of the bearing chocks, and wherein the guide frame is mounted in guide members connected to the roll stand so as to be movable in the axial direction of the rolls toward the bearing chock and away from the bearing chock.

7 Claims, 1 Drawing Sheet

DEVICE FOR COUPLING AND UNCOUPLING THE MEDIA SUPPLY LINES AT BEARING CHOCKS OF ROLLS, PARTICULARLY BACK-UP ROLLS, MOUNTED IN ROLL HOUSINGS

BACKGROUND OF THE INVENTION

1. Field of the Invention

The present invention relates to a device for coupling and uncoupling the media supply lines at bearing chocks of rolls, particularly back-up rolls, mounted in roll housings.

2. Description of the Related Art

Coupling and uncoupling of media supply lines poses difficulties particularly in the flood lubricated bearings of cold rolling stands because the coupling connections of the bearing chocks are also always located on the drive side of the roll stand. Accordingly, access to these coupling connections is made difficult and requires substantial experience of the operating personnel. This is particularly true for the relatively large coupling elements of the oil discharge lines.

SUMMARY OF THE INVENTION

Therefore, it is the primary object of the present invention to provide a device of the above-described type which makes it possible in spite of the described difficulties to couple the media supply lines with the coupling elements thereof quickly in a semiautomatic process to the connections in the bearing chocks and to uncouple them in the same manner.

In accordance with the present invention, the coupling elements of the media supply lines are arranged commonly in a carrier member so as to face the media connections in the bearing chock, wherein the carrier member is guided in a guide frame so as to be movable parallel to the direction of the adjustment movement of the bearing chocks, and wherein the guide frame is mounted in guide members connected to the roll stand so as to be movable in the axial direction of the rolls toward the bearing chock and away from the bearing chock.

In accordance with a feature of the present invention, the guide frame is composed of a pair of guide groove rails for the carrier member of the coupling elements constructed as a rectangular support plate, wherein the guide groove rails are connected above and below the support plate through transverse webs and the guide groove rails are with their ends slidably mounted on cantilever projections which are rigidly connected to the roll housing. This movement can be effected by means of a piston/cylinder unit arranged on the roll housing and connected to the guide frame.

In accordance with another useful feature of the present invention, a fixed centering bolt is provided at the outer side of the bearing chock, wherein the centering bolt can engage in a corresponding centering recess in the support member on which the coupling elements are mounted. For facilitating the coupling process, the coupling elements are mounted in a floating manner so as to be slightly transversely movable.

The device operates practically automatically. After the roll has been inserted into the roll stand, the support member is aligned by means of the centering bolt engaging in the centering recess relative to the bearing chock in such a way that the coupling elements mounted on the carrier member are located opposite the coupling connections of the bearing chock. After subsequently locking the rolls, the guide frame with the carrier member is moved by means of the piston/cylinder unit in the axial direction of the rolls toward the bearing chock and simultaneously the coupling elements of the media supply lines are coupled to the connections in the bearing chock. The stop provided at the bearing chock limits the movement of the guide frame. After the roll is unlocked, the carrier member follows the adjusting movements of the roll within the guide members of the guide frame.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
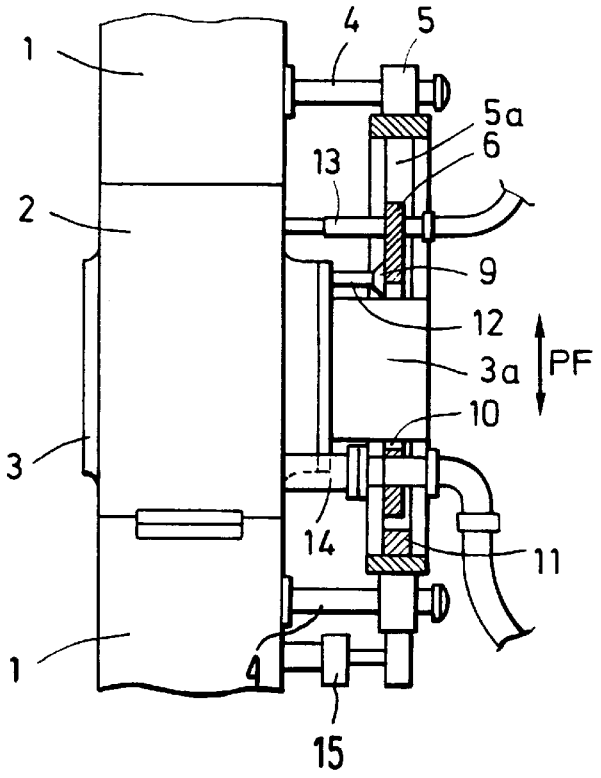
FIG. 1 s a schematic axial sectional view of the device according to the present invention.
Figure 2:
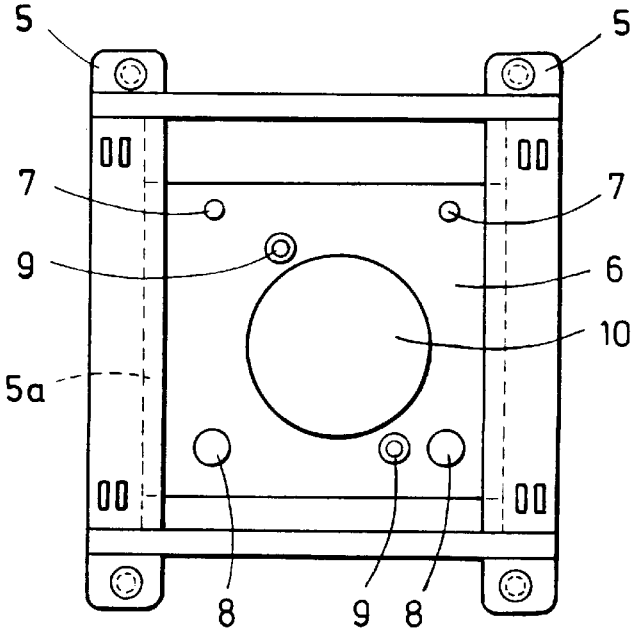
FIG. 2 is a side view of the device of FIG. 1.

As illustrated in FIG. 1, the bearing chock 2 is guided together with the roll 3 in the roll housing 1 so as to movable up and down in the direction of the double arrow PF. Arranged on the roll housing 1 above the chock 2 are cantilever projections 4 in which a guide frame 5 is suspended so as to be slidably movable. This guide frame 5 has inner guide grooves 5*a* which face each other and in which the rectangular support plate is guided. The coupling elements 7 and 8 are mounted in this support plate 6; also provided in this support plate are two centering recesses 9 and a center opening 10.

When the roll 3 is moved with its bearing chock 2 into the roll housing 1 as shown in FIG. 1, the roll journal 3*a* is moved through the center opening 10 and two centering bolts 12 rigidly arranged on the bearing chock 2 are inserted into the two centering recesses 9 of the support plate 6. Subsequently, by means of a piston/cylinder unit 15, the support frame 5 is pushed on the cantilever projections 4 toward the bearing chock 2 and the coupling elements 7 and 8 are simultaneously coupled to the media connections 13 and 14 of the bearing chock 2. A stop member 11 limits the downward movement of the support plate 6 and ensures that the support plate 6 is in the correct position when the roll 3 is moved in. In this coupling position, the adjusting movements of the roll 3 with the bearing chock in the direction of arrow PF are transmitted through the centering bolts 5 and the centering recesses 9 to the support plate 6. Consequently, the support plate 6 follows these adjusting movements guided in the guide grooves 5*a* of the support frame 5. The uncoupling procedure is carried out analogously by moving the support frame 5 on the support or cantilever projections 4 away from the bearing chock 2 by means of the above-mentioned distance/cylinder unit, not shown.

While specific embodiments of the invention have been shown and described in detail to illustrate the inventive principles, it will be understood that the invention may be embodied otherwise without departing from such principles.

I claim:

1. A device for coupling and uncoupling media supply lines at bearing chocks of rolls mounted in roll housings, the media supply lines having coupling elements and each bearing chock having media connections, and the rolls having an axial direction and the bearing chocks having an adjusting direction, the device comprising a carrier member, wherein the coupling elements are adapted to be mounted in the carrier member, a guide frame for guiding the carrier member in a direction parallel to the adjusting direction of the bearing chocks, guide members for attachment to the roll housing, wherein the guide frame is mounted so as to be movable on the guide members in the axial direction of the rolls toward and way from the bearing chocks, and wherein the guide frame is comprised of a pair of parallel guide groove rails for the carrier member for the coupling elements, the carrier member being comprised of a rectangular support plate, further comprising transverse webs connecting the guide groove rails above and below the carrier plate, and wherein ends of the guide groove rails are movable on the guide members.

2. The device according to claim 1, wherein the rolls are back-up rolls.

3. The device according to claim 1, wherein the guide members are cantilever projections adapted to be fixedly attached to the roll housing, and wherein the ends of the guide groove rails are movable on the cantilever projections.

4. The device according to claim 1, further comprising a piston/cylinder unit adapted for mounting on the roll stand and connected to the guide frame for moving the guide frame.

5. The device according to claim 4, further comprising a stop member mounted on the guide frame for limiting the movement of the carrier plate.

6. The device according to claim 1, wherein the carrier member has a center opening, further comprising a centering bolt adapted for mounting on the bearing chocks for engagement in the center opening of the carrier member.

7. The device according to claim 1, wherein the coupling elements are mounted in the carrier member in a floating manner so as to be transversely movable.

* * * * *